US009341985B2

(12) United States Patent
Mizukoshi

(10) Patent No.: US 9,341,985 B2
(45) Date of Patent: May 17, 2016

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventor: Shunsuke Mizukoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/887,020

(22) Filed: Oct. 19, 2015

(65) Prior Publication Data

US 2016/0109830 A1 Apr. 21, 2016

(30) Foreign Application Priority Data

Oct. 20, 2014 (JP) ..... 2014-213316

(51) Int. Cl.
*G03G 15/08* (2006.01)

(52) U.S. Cl.
CPC ..... *G03G 15/0898* (2013.01); *G03G 15/0865* (2013.01)

(58) Field of Classification Search
CPC ..... G03G 15/0898; G03G 15/0817; G03G 15/0812; G03G 15/0881; G03G 15/0808
USPC ..... 399/103
See application file for complete search history.

(56) References Cited

U.S. PATENT DOCUMENTS 5,880,244 A * 3/1999 Dowlen ..... C08G 77/12 399/106
2011/0103834 A1* 5/2011 Toba ..... G03G 15/0121 399/119
2011/0200353 A1* 8/2011 Kubo ..... G03G 15/0898 399/103
2015/0301495 A1* 10/2015 Kawaguchi ..... G03G 21/1661 399/12

FOREIGN PATENT DOCUMENTS

CN 101661262 A * 3/2010 ..... G03G 15/0813
JP 2005-181713 A 7/2005

* cited by examiner

*Primary Examiner* — Francis Gray
(74) *Attorney, Agent, or Firm* — Canon USA Inc. IP Division

(57) ABSTRACT

A developing device includes a developer bearing member. A lubricant is applied to a surface of the developer bearing member. In an axial direction of the developer bearing member, an end of the developer bearing member is located further outward than an outer end of a seal member, and an end of a cleaning member is located further outward than the end of the developer bearing member. In the axial direction of the developer bearing member, a first application quantity of the lubricant applied to the surface of the developer bearing member at a position further outward than the outer end of the seal member is larger than a second application quantity of the lubricant applied to the surface of the developer bearing member at a position corresponding to an opening.

11 Claims, 12 Drawing Sheets

FIG. 10

| | FIGURE | LUBRICANT APPLICATION QUANTITY ($\mu g/mm^2$) | | | | OCCURRED PROBLEM | |
|---|---|---|---|---|---|---|---|
| | | DEVELOPING ROLLER | | | DEVELOPMENT END SEAL | BLADE TURN-UP | IMAGE SOILING |
| | | Z1 | Z2 | Z3 | | | |
| FIRST EMBODIMENT | FIG. 6 | 4 | 4 | 10 | 0 | NO | NO |
| FIRST COMPARATIVE EXAMPLE | FIG. 7 | 4 | 4 | 4 | 0 | YES | NO |
| SECOND COMPARATIVE EXAMPLE | FIG. 8 | 10 | 10 | 10 | 0 | NO | YES |
| THIRD COMPARATIVE EXAMPLE | FIG. 9 | 4 | 4 | 4 | 10 | YES | NO |

FIG. 11

| WIDTH OF AREA Z3 (mm) | BLADE TURN-UP | | | | |
|---|---|---|---|---|---|
| | LUBRICANT APPLICATION QUANTITY IN AREA Z3 ($\mu g/mm^2$) | | | | |
| | 4 | 6 | 8 | 10 | 12 |
| 0.8 | YES | POSSIBLE | POSSIBLE | POSSIBLE | NO |
| 1.3 | YES | POSSIBLE | NO | NO | NO |
| 2.5 | YES | NO | NO | NO | NO |

FIG. 12

| WIDTH OF AREA Z4 (mm) | BLADE TURN-UP | | | | |
|---|---|---|---|---|---|
| | LUBRICANT APPLICATION QUANTITY IN AREA Z3 ($\mu g/mm^2$) | | | | |
| | 4 | 6 | 8 | 10 | 12 |
| 0.9 | YES | NO | NO | NO | NO |
| 1.4 | YES | POSSIBLE | NO | NO | NO |
| 2.6 | YES | POSSIBLE | POSSIBLE | POSSIBLE | NO |

DEVELOPING DEVICE, PROCESS CARTRIDGE, AND IMAGE FORMING APPARATUS

BACKGROUND OF THE INVENTION

1. Field of the Invention

The present invention relates to an image forming apparatus such as an electrophotographic printer and an electrophotographic copying machine which form images on recording media.

2. Description of the Related Art

In conventional image forming apparatuses such as a copier and a printer, methods such as an electrostatic recording method and an electrophotographic recording method are used in many cases. Of these methods, there is known a method of transferring a toner image formed on a photosensitive drum to an intermediate transfer member and a recording medium by electrostatic force acting between a transfer roller and the photosensitive drum.

The toner image on the photosensitive drum may not be completely transferred and thus a very small quantity of toner may remain on the photosensitive drum after the toner image is transferred to the recording medium. When charging is caused by bringing a charging device into contact with the photosensitive drum, this remaining toner adheres to the charging device, thereby causing a charging failure. This leads to vertical streaks and uneven density in an image, which is a problem. Therefore, the remaining toner is scraped off and collected by bringing a cleaning blade, which is made of an elastic member, into contact with the photosensitive drum.

However, the cleaning blade may be gradually turned up by a frictional force between the cleaning blade and a surface of the photosensitive drum, and thus become unable to scrape off the remaining toner. In other words, blade turn-up may occur.

There is a configuration in which a functional force between a cleaning blade and a surface of a photosensitive drum is reduced by sending toner into a contact portion between the cleaning blade and the photosensitive drum, as the toner serves as a lubricant.

Even in this case, blade turn-up easily occurs, in particular, at an end part of the cleaning blade in an initial state where a cartridge is installed. This is because, in general, a cleaning blade is disposed to be wider than an image formation region in many cases so that failure to scrape off the toner is prevented, and therefore, the toner sent to the cleaning blade is not easily distributed to an end part of the cleaning blade.

In this connection, one technique is known as follows. In this technique, a lubricant is applied beforehand to a surface, which is to be in contact with a developing roller, of a toner seal member. Such applied agent, which is the lubricant, is supplied to an end part of a cleaning blade via the developing roller and a photosensitive drum, thereby suppressing blade turn-up (Japanese Patent Application Laid-Open No. 2005-181713).

However, when the toner seal member and the end part of the cleaning blade are disposed away from each other in an axial direction of the photosensitive drum, the applied agent may not be sufficiently supplied to the end part of the cleaning blade, which may cause blade turn-up.

SUMMARY OF THE INVENTION

According to an aspect of the present invention, a developing device configured to be used for an image forming apparatus includes a developer container configured to accommodate a developer and to have an opening, a developer bearing member configured to be rotatably provided and to bear the developer, and a seal member, and configured be provided at an end of the opening of the developer container in an axial direction of the developer bearing member and to come into contact with a peripheral surface of the developer bearing member to suppress leakage of the developer borne by the developer bearing member, wherein a lubricant is applied to a surface of the developer bearing member, wherein, in the axial direction of the developer bearing member, an end of the developer bearing member is located further outward than an outer end of the seal member, and an end of a cleaning member is located further outward than the end of the developer bearing member, and wherein, in the axial direction of the developer bearing member, a first application quantity of the lubricant applied to the surface of the developer bearing member at a position further outward than the outer end of the seal member is larger than a second application quantity of the lubricant applied to the surface of the developer bearing member at a position corresponding to the opening.

Further features of the present invention will become apparent from the following description of exemplary embodiments with reference to the attached drawings.

BRIEF DESCRIPTION OF THE DRAWINGS

FIG. 10 is a table illustrating a lubricant application quantity in each area, in a case illustrated in each of FIGS. 6 to 9, and illustrating an occurred problem along therewith.

FIG. 11 is a table illustrating a lubricant application quantity in an area Z3 illustrated in FIG. 6, for each of cases that vary in width of the area Z3.

FIG. 12 is a table illustrating a lubricant application quantity in the area Z3 illustrated in FIG. 6, for each of cases that vary in width of an area Z4.

DESCRIPTION OF THE EMBODIMENTS

Exemplary embodiments of the present invention will be described in detail below with reference to the drawings.

Dimensions, materials, shapes, relative configurations, and the like of components to be described in a first exemplary embodiment may be modified as appropriate, and are not intended to limit the scope of the invention to the first exemplary embodiment to be described below.

<Overall Configuration of Image Forming Apparatus>

Figure 1:
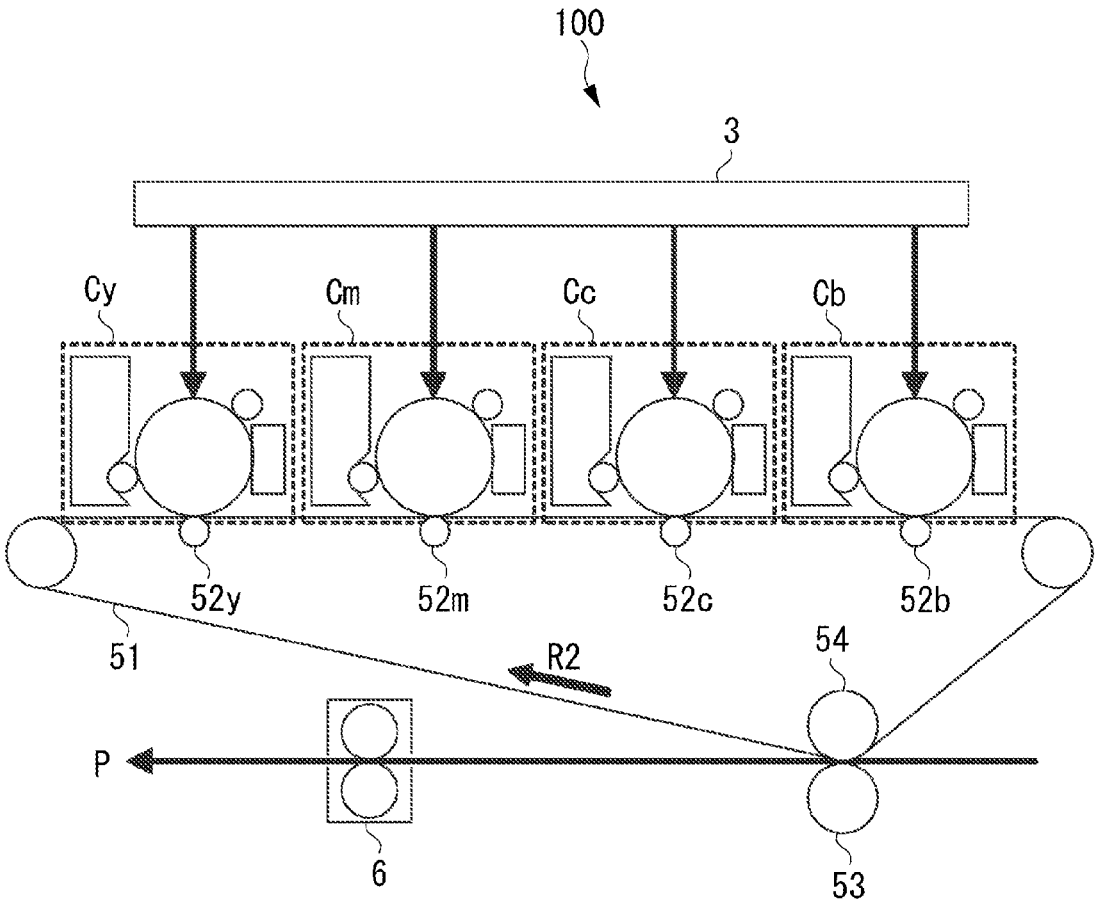
FIG. 1 is a schematic cross-sectional diagram illustrating a configuration of an image forming apparatus according to a first exemplary embodiment of the present invention.

FIG. 1 is a schematic cross-sectional diagram illustrating a configuration of an image forming apparatus 100 according to the first exemplary embodiment of the present invention.

As illustrated in FIG. 1, the image forming apparatus 100 of the first exemplary embodiment includes process cartridges Cy, Cm, Cc, and Cb that store toner of yellow y, toner of magenta m, toner of cyan c, and toner of black b, respectively. The process cartridges Cy, Cm, Cc, and Cb are detachably attached to a main body of the image forming apparatus 100. In a state of being attached to the main body of the image forming apparatus 100, the process cartridges Cy, Cm, Cc, and Cb execute a part of an image forming operation.

The image forming apparatus 100 further includes an intermediate transfer belt 51 provided to be capable of circulating in an arrow R2 direction. Further, primary transfer rollers 52*y*, 52*m*, 52*c*, and 52*b* are provided to face the process cartridges Cy, Cm, Cc, and Cb, respectively, with the intermediate transfer belt 51 interposed therebetween.

Figure 2:
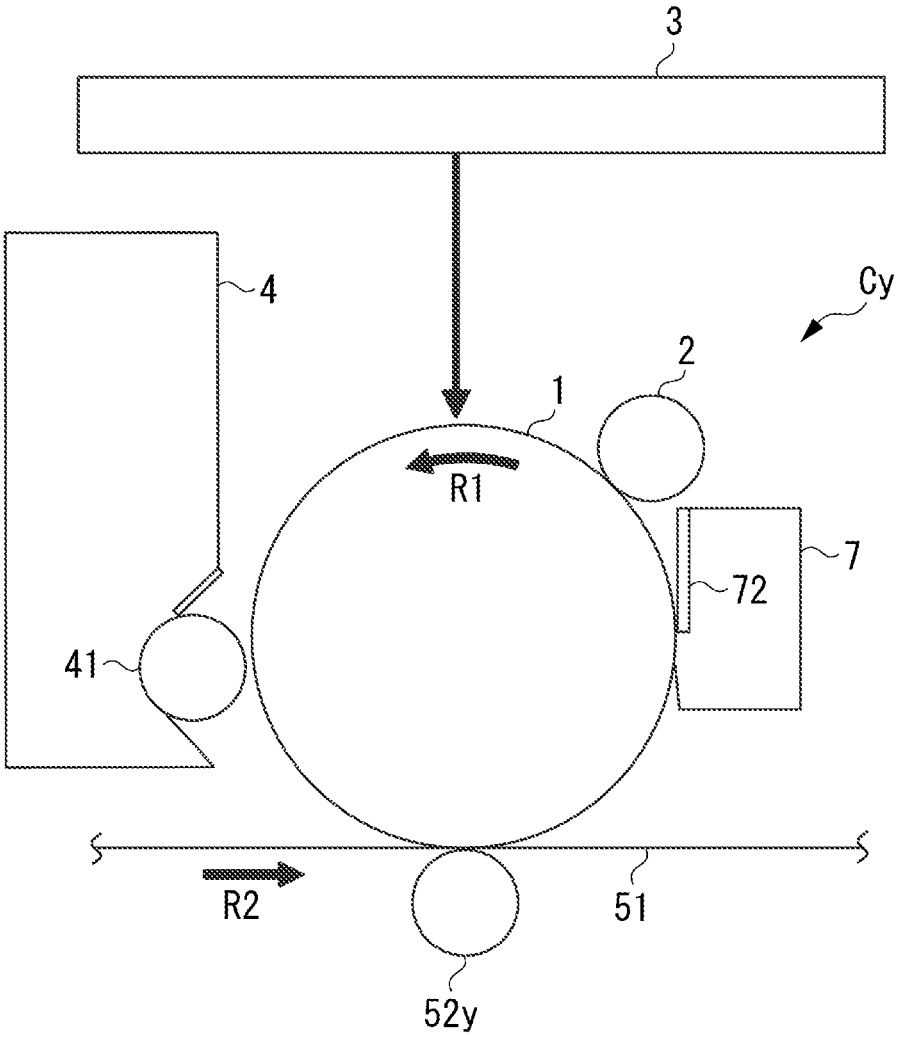
FIG. 2 is a schematic cross-sectional diagram illustrating a configuration of a process cartridge according to the first exemplary embodiment of the present invention.

FIG. 2 is a schematic cross-sectional diagram illustrating a configuration of the process cartridge Cy. The process cartridges Cm, Cc, and Cb have configurations similar to the configuration of the process cartridge Cy, except that the stored toner colors are different.

As illustrated in FIG. 2, the process cartridge Cy includes a photosensitive drum 1 (an image bearing member), a charging roller 2 (a charging unit), a developing device 4, and a cleaning device 7.

The photosensitive drum 1 is uniformly charged by the charging roller 2 to predetermined polarity and potential, while rotating in an arrow R1 direction at a speed of 164 rpm. A laser beam for exposure is emitted from an exposure device 3 onto the photosensitive drum 1, so that an electrostatic latent image is formed.

The developing device 4 stores nonmagnetic one-component toner (hereinafter simply referred to as "toner") having negative chargeability, and includes a developing roller 41 (a developer bearing member) capable of rotating. The developing roller 41 is configured to be capable of being in contact with and separated from the photosensitive drum 1. In a state where the developing roller 41 is in contact with the photosensitive drum 1, the toner is supplied from the developing roller 41 onto the photosensitive drum 1, to visualize the electrostatic latent image, so that a toner image (a developer image) is formed.

The toner image formed on the photosensitive drum 1 is primarily transferred to the intermediate transfer belt 51 by a bias applied to the primary transfer roller 52*y*.

The toner image primarily transferred onto the intermediate transfer belt 51 is conveyed to a secondary transfer position, which is a nip portion between a secondary transfer roller 53 and a secondary transfer facing roller 54, by circular movement of the intermediate transfer belt 51, as illustrated in FIG. 1.

The toner image is then secondarily transferred to a recording medium P at the secondary transfer position. The toner image secondarily transferred onto the recording medium P is fixed onto the recording medium P by being pressurized and heated by a fixing device 6, thereby becoming a final image.

Of the toner image formed on the photosensitive drum 1, a part of the toner remains without being transferred to the intermediate transfer belt 51. This remaining part of the toner is conveyed to the cleaning device 7, and scraped from a surface of the photosensitive drum 1.

<Configuration of Developing Device 4>

A configuration of the developing device 4 will be described.

Figure 3:
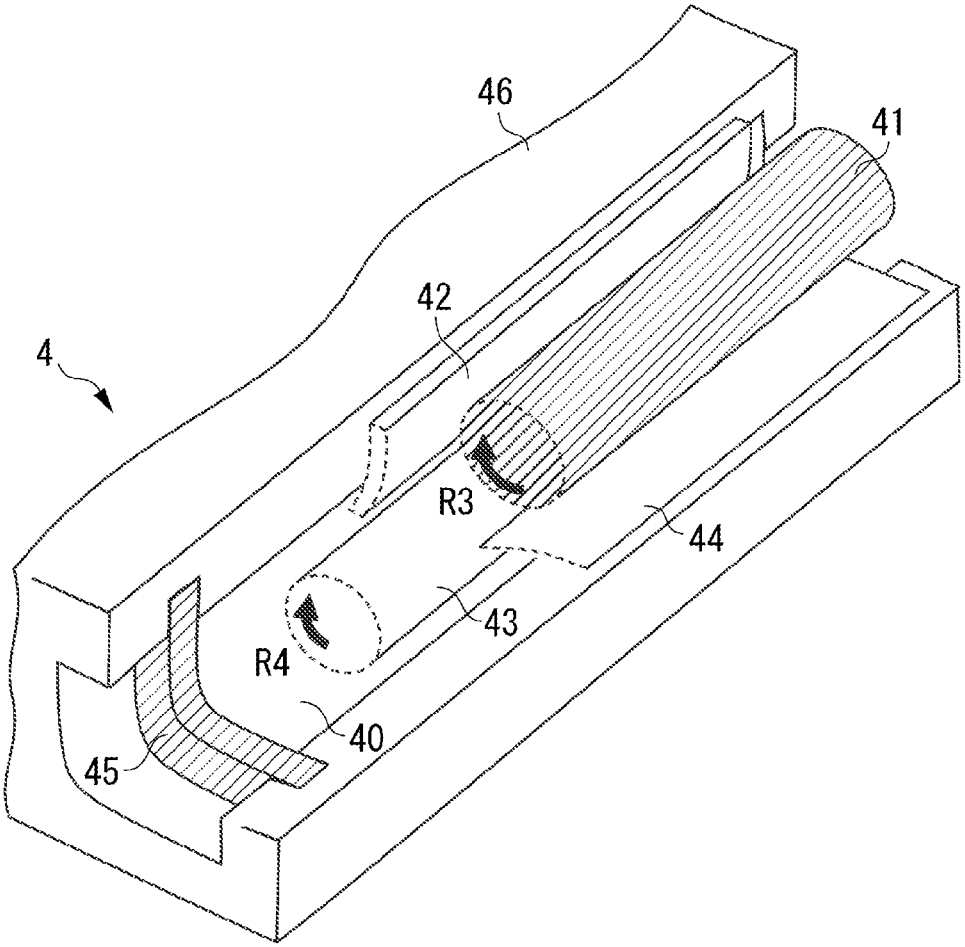
FIG. 3 is a schematic perspective diagram illustrating a configuration of a developing device according to the first exemplary embodiment of the present invention.

FIG. 3 is a schematic perspective diagram illustrating a configuration of the developing device 4. In FIG. 3, some members located on the front are partially cut away to describe placement of each member.

As illustrated in FIG. 3, the developing device 4 includes the developing roller 41, a regulation blade 42 (a regulation member), a developer feed roller 43 (a developer feed member), a blowout prevention sheet 44, a development end seal 45 (a seal member), and a frame 46 (a developer container). The blowout prevention sheet 44 and the development end seal 45 are provided for sealing to prevent leakage of a developer.

The toner accommodated in the frame 46 is supplied to the developing roller 41 from a development opening 40 defined by the frame 46, the blowout prevention sheet 44 and the development end seal 45.

The developing roller 41 is an elastic roller, and rotates in an arrow R3 direction. The regulation blade 42 is a stainless used steel (SUS) plate, and regulates a toner quantity on the developing roller 41 to a substantially uniform quantity by coming into contact with the developing roller 41.

The developer feed roller 43 is a roller made of a foaming member capable of holding the toner. The developer feed roller 43 supplies the toner to the developing roller 41 by rotating in an arrow R4 direction while being in contact with the developing roller 41.

The blowout prevention sheet 44 is a flexible sheet member, and prevents leakage of the toner from the frame 46 by being in tight contact with the developing roller 41 and the development end seal 45.

The development end seal 45 is an elastic member in which a surface in contact with the developing roller 41 has been processed to have minute bristles. The development end seal 45 prevents leakage of the toner from an end of the frame 46 by being in tight contact with the developing roller 41, the regulation blade 42, the blowout prevention sheet 44, and the frame 46.

Further, the toner (developer), serving as a lubricant, is applied beforehand to the developing roller 41 before use. This is mainly to prevent abrasion and peeling of the developer feed roller 43 by reducing a frictional force between the developing roller 41 and the developer feed roller 43.

The same material as the toner contained in the frame 46 is used for the lubricant. However, other type such as "TOSPEARL" made by Momentive Performance Materials Japan LLC, for example, may be used.

<Configuration of Cleaning Device 7>

A configuration of the cleaning device 7 will be described.

Figure 4:
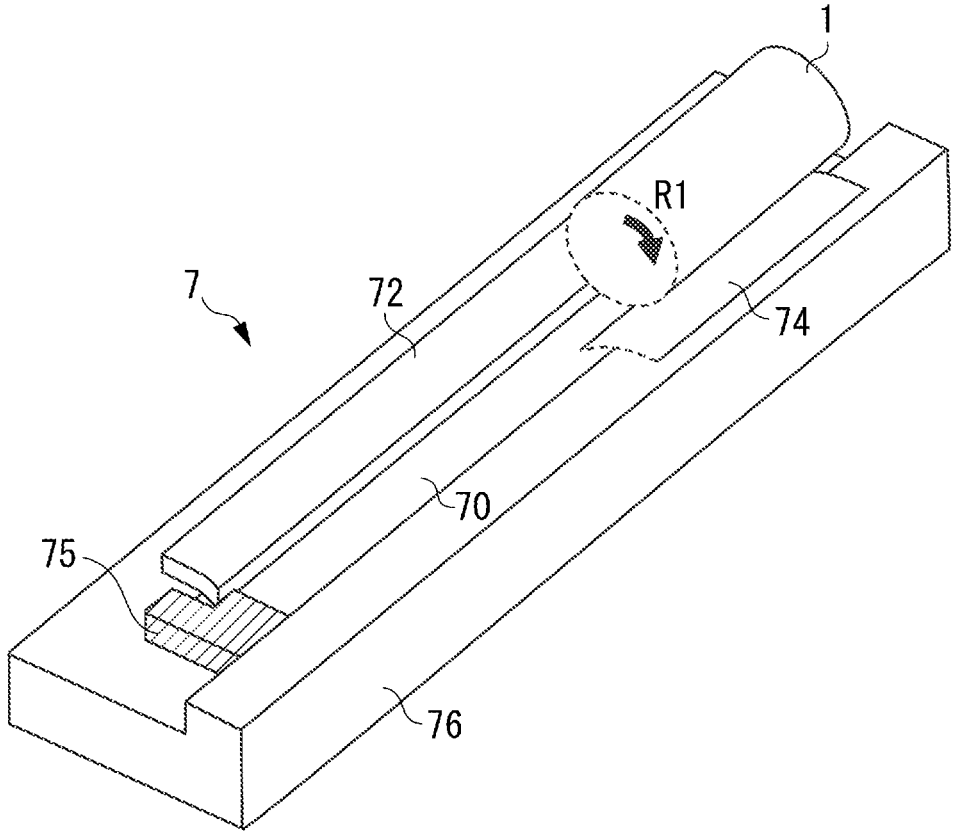
FIG. 4 is a schematic perspective diagram illustrating a configuration of a cleaning device according to the first exemplary embodiment of the present invention.

FIG. 4 is a schematic perspective diagram illustrating a configuration of the cleaning device 7, together with the photosensitive drum 1. In FIG. 4, some members located on the front are partially cut away to describe placement of each member.

As illustrated in FIG. 4, the cleaning device 7 includes a cleaning blade 72 (a cleaning member), a scooping sheet 74, a cleaning end seal 75, and a frame 76.

The cleaning blade 72 is an elastic member, and scrapes the toner on the photosensitive drum 1 by coming into contact with the photosensitive drum 1. The scraped toner is accumulated in the frame 76 by entering from a cleaning opening 70 defined by the frame 76, the scooping sheet 74 and the cleaning end seal 75. The cleaning blade 72 is provided at a part other than the developing device 4 of the image forming apparatus 100. In the developing device, an end of the image bearing member provided at a part other than the developing device is located further outward than the end of the cleaning member in the axial direction of the developer bearing member.

The scooping sheet 74 is a flexible sheet member, and prevents leakage of the toner from the frame 76 by being in tight contact with the photosensitive drum 1 and the cleaning end seal 75.

The cleaning end seal 75 is an elastic member in which a surface in contact with the developing roller 41 has been processed to have minute bristles. The cleaning end seal 75 prevents leakage of the toner from an end of the frame 76 by being in tight contact with the photosensitive drum 1, the cleaning blade 72, the scooping sheet 74, and the frame 76.

<Positional Relation of Each Member of Developing Device and Cleaning Device>

Positional relations of the members of the developing device 4 and the cleaning device 7, in an axial direction of the photosensitive drum 1 (hereinafter simply referred to as "axial direction"), will be described.

Figure 5:
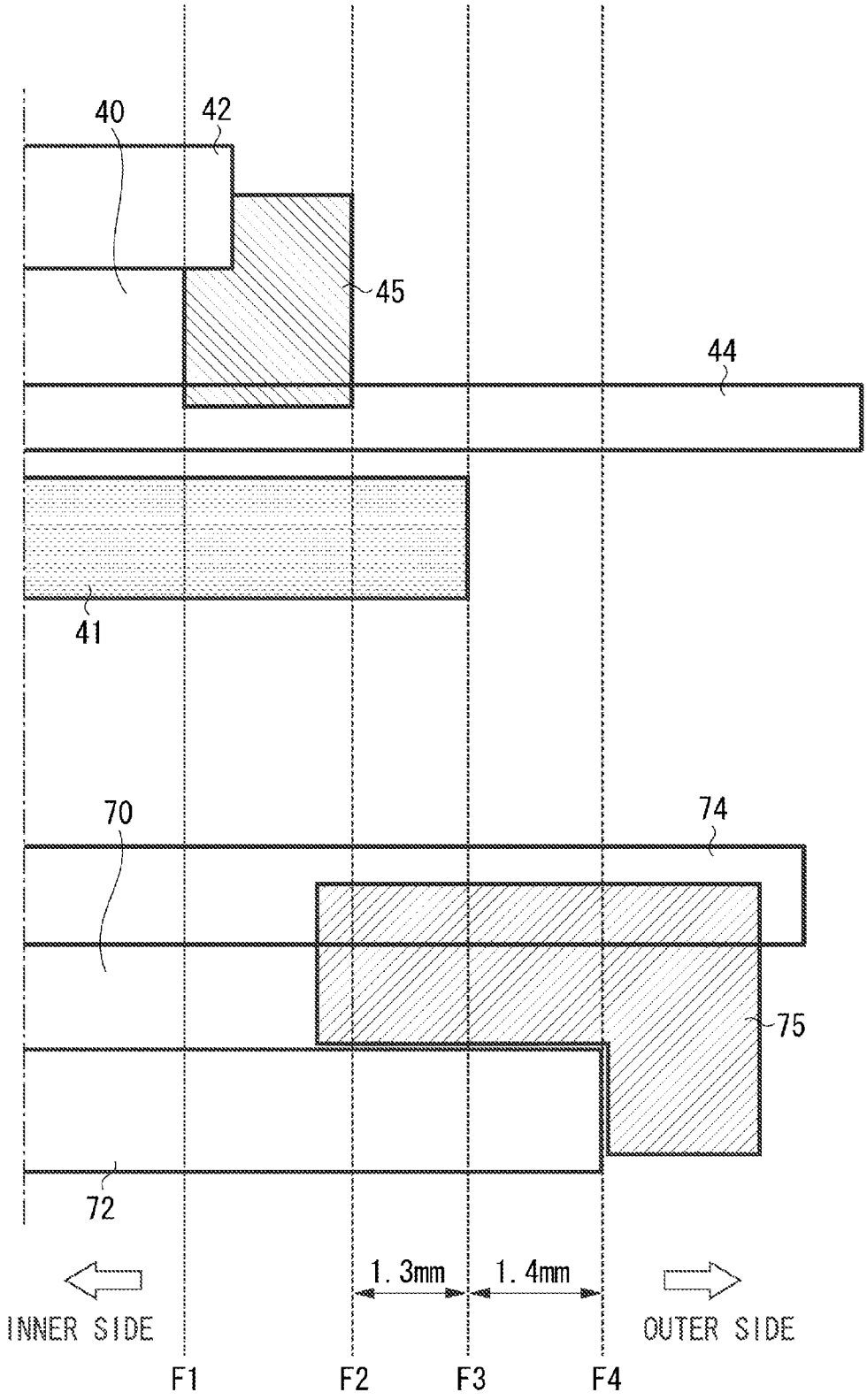
FIG. 5 is a schematic perspective diagram illustrating a positional relation of each member in the first exemplary embodiment of the present invention.

FIG. 5 is a schematic diagram illustrating a positional relation, in the axial direction, of each member provided in the developing device 4 and the cleaning device 7. Each member having both ends in the axial direction is substantially symmetrical. Therefore, only the end on one side is illustrated, and the end on the other side is omitted. In FIG. 5, a left side corresponds to an inner side in the axial direction, and a right side corresponds to an outer side in the axial direction.

In FIG. 5, each of vertical break lines indicates a reference line of an axial position. An axial position F1 indicates a position of an inner end of the development end seal 45, and an axial position F2 indicates a position of an outer end of the development end seal 45. Further, an axial position F3 indicates a position of an end of the developing roller 41, and this position is located further outward than the axial position F2 by 1.3 mm. An axial position F4 indicates an end of the cleaning blade 72, and is located further outward than the axial position F3 by 1.4 mm.

An image formation region where the developer is supplied to the recording medium P is located further inward than the axial position F1.

In the first exemplary embodiment, the developer feed roller 43 has a length of 220.0 mm in the axial direction, the regulation blade 42 has a length of 225.6 mm in the axial direction, the developing roller 41 has a length of 234.2 mm in the axial direction, and the cleaning blade 72 has a length of 237.0 mm in the axial direction. Further, the development end seal 45 has a length of 5.0 mm in the axial direction.

<Lubricant Application Quantity and Occurred Problem>

Supply of the lubricant from the developing device 4 to the cleaning device 7 and occurred problems will be described.

Figure 6:
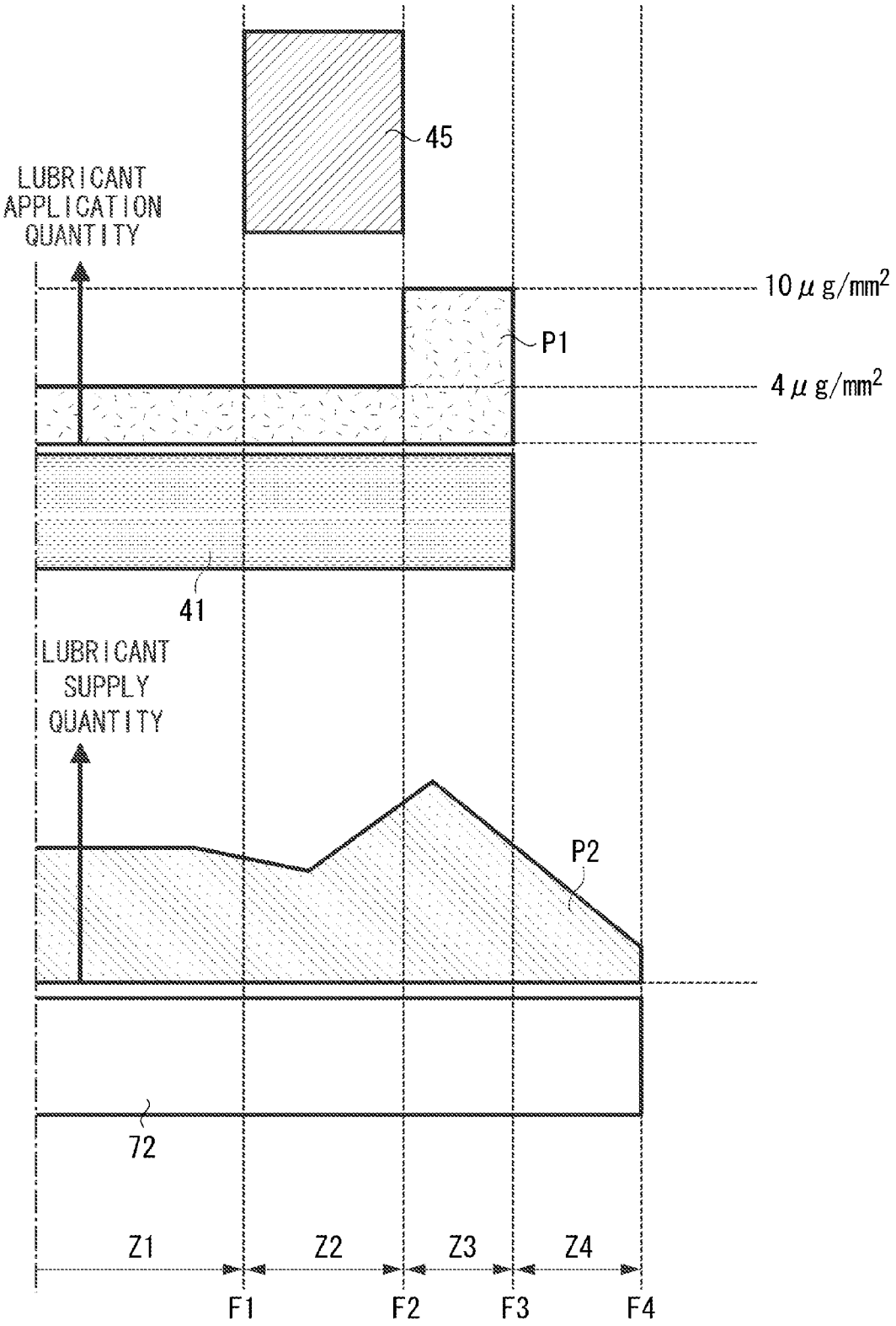
FIG. 6 is a schematic diagram illustrating an application quantity of a lubricant in the first exemplary embodiment of the present invention.
Figure 7:
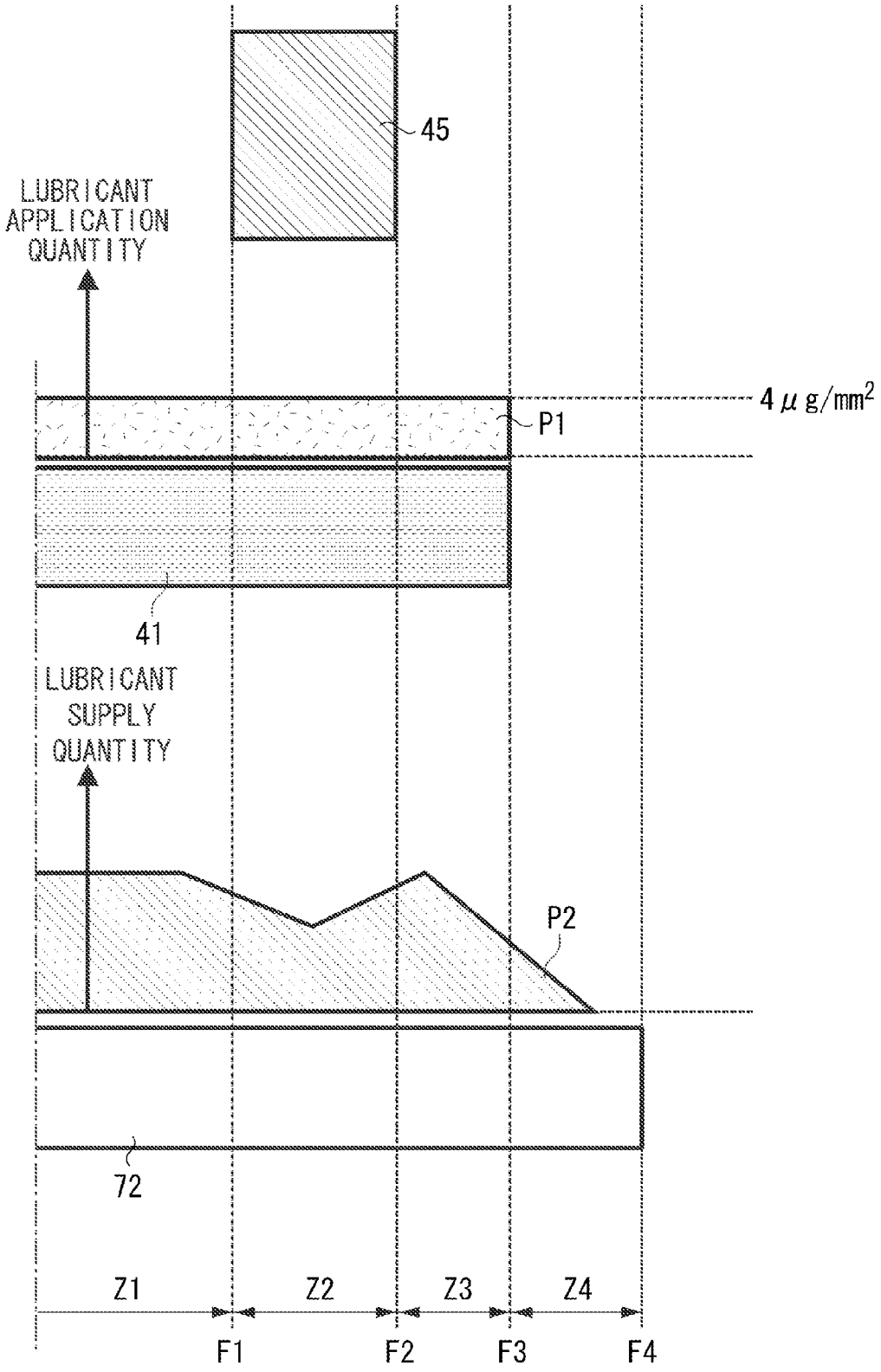
FIG. 7 is a schematic diagram illustrating an application quantity of a lubricant in a first comparative example.
Figure 8:
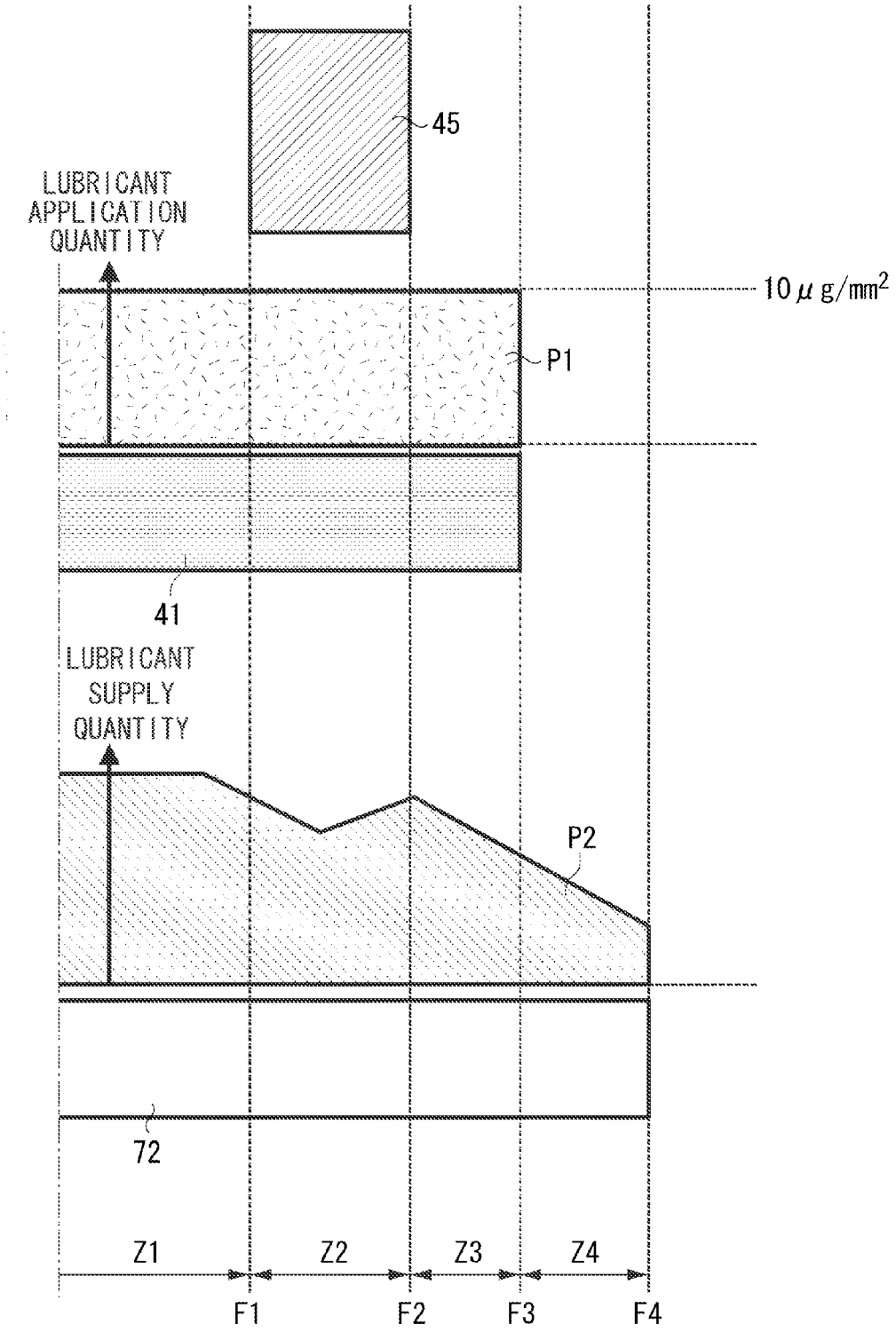
FIG. 8 is a schematic diagram illustrating an application quantity of a lubricant in a second comparative example.
Figure 9:
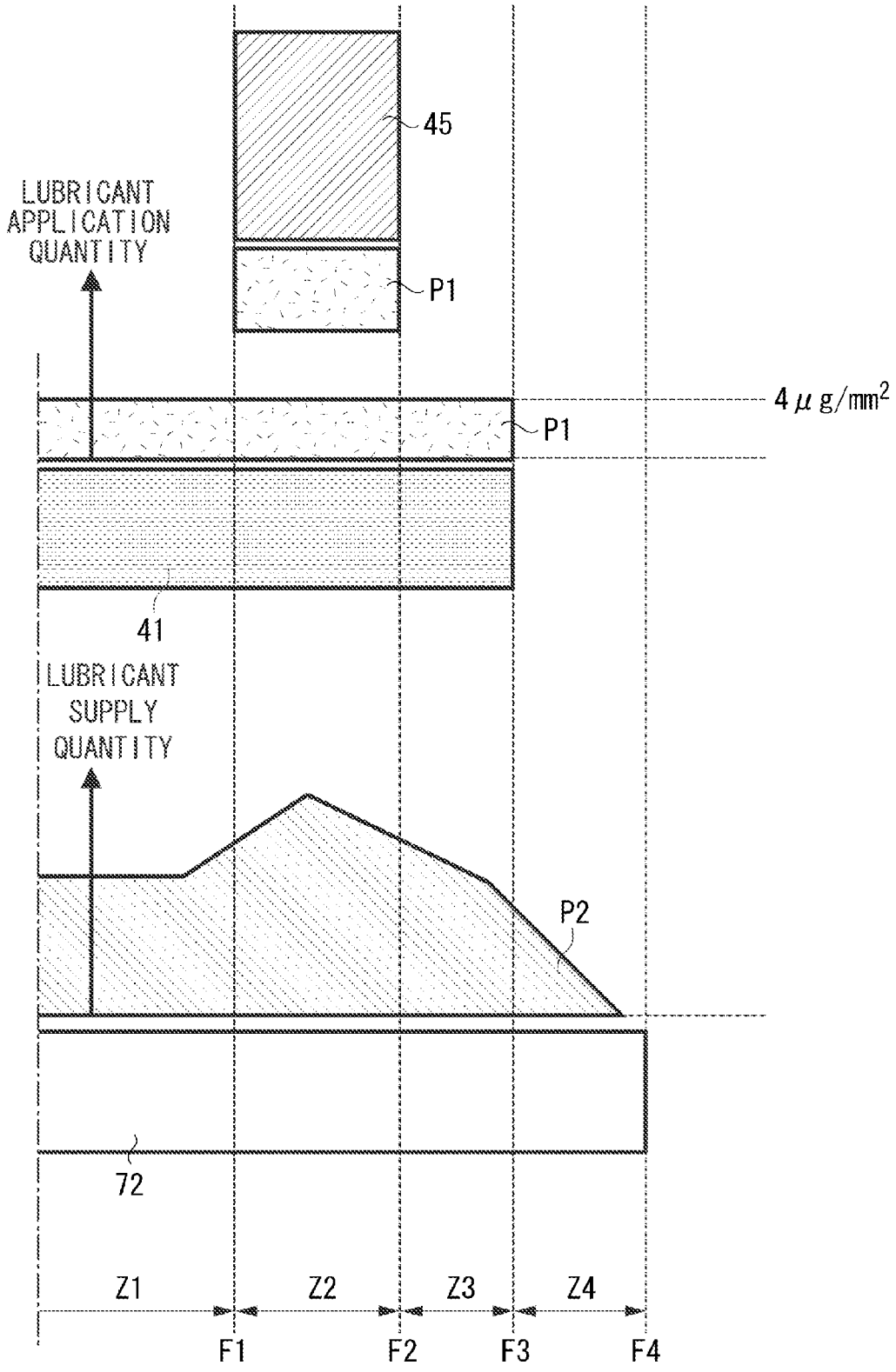
FIG. 9 is a schematic diagram illustrating an application quantity of a lubricant in a third comparative example.

FIGS. 6 to 9 are schematic diagrams each illustrating an application quantity of the lubricant applied to the developing roller 41 and the development end seal 45, and a supply quantity of the lubricant supplied to the cleaning blade 72. FIG. 6 illustrates the first exemplary embodiment, and FIGS. 7 to 9 illustrate first to third comparative examples, respectively.

In each of FIGS. 6 to 9, a horizontal axis schematically indicates an axial position for each of an application lubricant P1 applied to the developing roller 41 and the development end seal 45, and a supply lubricant P2 supplied to the cleaning blade 72. Further, a vertical axis schematically indicates an application quantity of the lubricant and a supply quantity of the lubricant for the application lubricant P1 and the supply lubricant P2, respectively.

As for the axial position, a part further inward than the axial position F1 is assumed to be an area Z1, and a part between the axial position F1 and the axial position F2 is assumed to be an area Z2. Further, a part between the axial position F2 and the axial position F3 is assumed to be an area Z3, and a part further outward than the axial position F3 is assumed to be an area Z4.

FIG. 10 is a table indicating the quantity of the application lubricant P1 for each area, in each of the first exemplary embodiment illustrated in FIG. 6 and the first to third comparative examples illustrated in FIGS. 7, 8, and 9, respectively. The table also indicates an occurred problem for each case. A term "image soiling" in the table illustrated in FIG. 10 refers to splattered soiling that results from dispersion of the developer onto the intermediate transfer belt 51. This image soiling will be described in description of the second comparative example.

<Lubricant Application Quantity of First Exemplary Embodiment>

The application quantity of the lubricant in the first exemplary embodiment will be described using FIG. 6. In the first exemplary embodiment, a lubricant application quantity (a second application quantity) in the area Z1 and a lubricant application quantity in the area Z2 of the developing roller 41 are each assumed to be 4 $\mu g/mm^2$. The area Z1 is located further inward than the development end seal 45 (i.e., at a position corresponding to the opening) in the axial direction. This application quantity of 4 $\mu g/mm^2$ is an application quantity equal to or more than a quantity necessary to avoid an occurrence of an adverse effect in an image due to abrasion of the developer feed roller 43, in the configuration according to the first exemplary embodiment. On the other hand, a lubricant application quantity (a first application quantity) in the area Z3 of the developing roller 41 is assumed to be 10 $\mu g/mm^2$. The area Z3 is located further outward than the development end seal 45 in the axial direction. In other words, the first application quantity is larger than the second application quantity in terms of application quantity per unit area.

Movement of the application lubricant P1 of the first exemplary embodiment will be described.

Driving begins in a state where the photosensitive drum 1 and the developing roller 41 are in contact with each other. In the area Z2, a part of the application lubricant P1 is then peeled off by the development end seal 45, because the developing roller 41 and the development end seal 45 are in contact with each other. Meanwhile, another part of the application lubricant P1 remains in the area Z2 without being peeled off by the development end seal 45. The lubricant in the area Z1 and the area Z3 as well as the remaining part of the lubricant in the area Z2 are supplied to the cleaning blade 72 via the photosensitive drum 1.

By a rotational motion of the photosensitive drum 1, the supplied lubricant is spread toward both sides in the axial direction at a contact portion between the cleaning blade 72 and the photosensitive drum 1, so that the supply quantity is leveled. Therefore, the supply lubricant P2 is distributed to the cleaning blade 72, as indicated by a supply quantity illustrated in a lower part of FIG. 6.

In the area Z2, the application lubricant P1 is partially peeled off by the development end seal 45 as described above, and therefore, the supply quantity for the area Z1 decreases. Meanwhile, although the developing roller 41 is not present in the area Z4, the lubricant is supplied to the area Z4 to some extent, because a part of the lubricant supplied to the area Z3 next to the area Z4 is spread to the area Z4.

In the first exemplary embodiment, the lubricant quickly spreads out to the axial position F4 of the end of the cleaning blade 72, so that an occurrence of blade turn-up can be prevented. A time period necessary for spreading out of the lubricant to the axial position F4 of the end of the cleaning blade 72 and an effect thereof will be described below.

As described above, in the first exemplary embodiment, on the developing roller 41, the lubricant application quantity in the area Z3 located further outward in the axial direction than the development end seal 45 is larger than the application quantity in the development opening 40. Therefore, it is possible to prevent blade turn-up without producing an adverse effect.

<Lubricant Application Quantity in First Comparative Example>

The first comparative example of the first exemplary embodiment will be described using FIG. 7.

In the first comparative example, the lubricant of 4 μg/mm$^2$ is uniformly applied onto the developing roller 41. In this state, the supply lubricant P2 is spread from the area Z3 to the area Z4, but the quantity of the application lubricant P1 in the area Z3 is small as compared with the first exemplary embodiment. Therefore, blade turn-up may occur, before the lubricant of a quantity sufficient for preventing blade turn-up is spread to the axial position F4 of the end of the cleaning blade 72.

<Lubricant Application Quantity in Second Comparative Example>

The lubricant uniformly applied onto the developing roller 41 in the first comparative example is therefore increased to 10 μg/mm$^2$, and this case will be described as the second comparative example by using FIG. 8.

In this case, as compared with the first comparative example, the lubricant supply quantity for the cleaning blade 72 is large, and the lubricant of a quantity sufficient for preventing blade turn-up is immediately supplied to the axial position F4 of the end of the cleaning blade 72. Therefore, in the second comparative example, there is no occurrence of blade turn-up.

However, as illustrated in the table of FIG. 10, image soiling occurs in the second comparative example. The image soiling will be described as below.

In the second comparative example, the quantity of the application lubricant P1 on the developing roller 41 is large. Therefore, the lubricant is stacked in multiple stages, so that adhesion of the lubricant to the developing roller 41 is too weak. Therefore, in the area Z1 serving as the image formation region, the lubricant is scraped by a contact pressure of the blowout prevention sheet 44. This scraped lubricant adheres to the intermediate transfer belt 51 and the recording medium P, thereby appearing as splattered image soiling.

Therefore, it is difficult to say that uniformly increasing the quantity of the lubricant in the axial direction is a desirable solution to the blade turn-up, because this approach results in an adverse effect of "image soiling".

In the first exemplary embodiment, only the quantity of the lubricant in the area Z3 is 10 μg/mm$^2$. The area Z3 is outside the image formation region. Therefore, in the first exemplary embodiment, there is no occurrence of image soiling, as illustrated in the table of FIG. 10. In other words, in the area Z1 and the area Z2, the application quantity is smaller than a minimum quantity that leads to the above-described image soiling.

<Lubricant Application Quantity in Third Comparative Example>

Further, in contrast to the above-described comparative examples, the lubricant is applied beforehand to the development end seal 45 in another case, as in the conventional example described earlier. This case will be described as the third comparative example by using FIG. 9.

Blade turn-up occurs in this case as well and therefore, this case is insufficient to be a solution. In the third comparative example, the quantity of the supply lubricant is increased indeed, as compared with the first comparative example. However, when the axial position F2 of the end of the development end seal 45 and the axial position F4 of the end of the cleaning blade 72 are away from each other to some extent as in the first exemplary embodiment, the photosensitive drum 1 needs to be rotated further by a distance for spreading the lubricant in the axial direction. Therefore, in some cases, the lubricant of a quantity sufficient for preventing blade turn-up cannot be spread to the axial position F4 of the end of the cleaning blade 72 before occurrence of the blade turn-up, and as a result, the blade turn-up occurs.

In the first exemplary embodiment, the lubricant of the quantity equal to or more than the quantity sufficient for preventing blade turn-up is applied to the area Z3.

In the above-described first exemplary embodiment, the relationship between the lubricant application quantity and the occurred problem has been described, by using the case where the width of the area Z3 and the width of the area Z4 are 1.3 mm and 1.4 mm, respectively. However, if the width of the area Z3 and the width of the area Z4 are varied, the relationship between the lubricant application quantity and the occurred problem also varies. Therefore, presence or absence of an occurrence of blade turn-up, when the width of the area Z3 and the width of the area Z4 are varied, will be described below.

FIG. 11 illustrates the lubricant application quantity in the area Z3 whose width is different from the width of the area Z3 in the first exemplary embodiment. Here, various parameters, which include the lubricant application quantity in each of the area Z1 and the area Z2 as well as the width of the area Z4, are values identical to those in the first exemplary embodiment. In FIG. 11, "NO" indicates a case where there is no occurrence of blade turn-up, "YES" indicates a case where there is an occurrence of blade turn-up, and "POSSIBLE" indicates a case where some blade turn-up may occur. If the width of the area Z3 is decreased as compared with the case in which the width of the area Z3 is 1.3 mm that is the configuration of the first exemplary embodiment, the lubricant application quantity necessary for preventing an occurrence of blade turn-up increases. On the other hand, if the width of the area Z3 is increased as compared with the configuration of the first exemplary embodiment, the lubricant application quantity necessary for preventing an occurrence of blade turn-up decreases. As illustrated in FIG. 11, when the lubricant of a quantity double to triple the lubricant in the area Z1 and the area Z2 is applied to the area Z3, blade turn-up can be effectively suppressed.

FIG. 12 is a table illustrating the lubricant application quantity in the area Z3, for each of cases that vary in the width of the area Z4. In FIG. 12, "NO" indicates a case where there is no occurrence of blade turn-up, "YES" indicates a case where there is an occurrence of blade turn-up, and "POSSIBLE" indicates a case where some blade turn-up may occur.

Various parameters, which include the lubricant application quantity in each of the area Z1 and the area Z2 as well as the width of the area Z3, are assumed to be values identical to those in the first exemplary embodiment.

If the width of the area Z4 is decreased as compared with the case where the width of the area Z4 is 1.4 mm that is the configuration of the first exemplary embodiment, the lubricant application quantity necessary for preventing an occurrence of blade turn-up decreases. On the other hand, if the width of the area Z4 is increased, the lubricant application quantity necessary for preventing an occurrence of blade turn-up increases.

In each configuration illustrated in the table of FIG. 12, a time period until the occurrence of the blade turn-up is 60 seconds, which is a value remaining unchanged regardless of whether the lubricant application quantity in the width of each of the area Z3 and the area Z4 is large or small.

At an axial end, a time period until blade turn-up occurs in a state where the lubricant is absent at the contact portion between the photosensitive drum 1 and the cleaning blade 72 is 60 seconds in every case. By increasing the lubricant application quantity in the area Z3, the lubricant can be spread more quickly from the axial position F3 of the end of the developing roller 41 to a position further outward in the axial direction.

In the first exemplary embodiment, the photosensitive drum 1 and the developing roller 41 are simultaneously driven, in a state of being in contact with each other. Assume that the photosensitive drum 1 is driven in a state where the photosensitive drum 1 and the developing roller 41 are away from each other, and subsequently the developing roller 41 is brought into contact therewith. In this case, a time period until the lubricant is spread to the axial position F4 of the end of the cleaning blade 72 is necessary.

In the first exemplary embodiment, the time period necessary for spreading the lubricant to the axial position F4 of the end of the cleaning blade 72 is 15 seconds after the photosensitive drum 1 and the developing roller 41 are simultaneously driven. As described above, the time period from the driving of the photosensitive drum 1 to the occurrence of the blade turn-up is 60 seconds at the earliest. Therefore, if the driving is caused in the state where the photosensitive drum 1 and the developing roller 41 are away from each other, it is desirable to bring the photosensitive drum 1 and the developing roller 41 into contact with each other within 45 seconds at the latest, in the configuration of the first exemplary embodiment.

In addition, in the first exemplary embodiment, there has been described the case where only the application quantity for the part corresponding to the area Z3 is increased relative to the lubricant application quantity in the area Z1. However, the application quantity of the part corresponding to the area Z2 may also be increased together with the increase in the area Z3.

Moreover, as a method of increasing a part of the lubricant application quantity of the developing roller 41, there is used a method of uniformly increasing the application quantity on the entire outer peripheral surface of the developing roller 41, and then scraping off only a part where an increase in the application quantity is unnecessary. Besides this, there may be used a method of uniformly applying the lubricant of a quantity not to cause abrasion of a supply roller to the entire outer peripheral surface of the developing roller 41, and then further applying only to the axial end. Alternatively, another method may be used as follows. For example, in a device (not illustrated) for applying the lubricant to the developing roller 41, after the lubricant supply quantity for an application member of directly applying the lubricant to the developing roller 41 is adjusted beforehand to be large at ends on both sides in the axial direction, the lubricant may be collectively applied. Further, in the first exemplary embodiment, the lubricant application quantity is changed in stages in the axial direction, but may be changed continuously. For example, when a roller-shaped member is used as the application member, this application member may be formed to have an inverse crown shape having a larger diameter at a part on the outer side in the axial direction. In this case, the lubricant application quantity may be adjusted to be larger at a position further outward in the axial direction, by increasing an amount of contact between the application member and the developing roller 41.

The above-described relationship between the lubricant application quantity and the occurred problem is strictly based on the values in the exemplary embodiment. In other words, this relationship varies according to surface property of each of the photosensitive drum 1 and the cleaning blade 72, flowability of the lubricant, hardness of the cleaning blade 72, the rotation speed of the photosensitive drum 1, and the like. Therefore, this relationship is not intended to limit the scope of effects of the present invention to the above-described exemplary embodiment.

In the above-described exemplary embodiment, the case of employing a full-color image forming apparatus using four colors has been described, but a case of employing an image forming apparatus using a single color may be adopted. Similarly, not only the entire image forming apparatus, but the process cartridge as illustrated in FIG. 2 may be adopted.

According to the exemplary embodiment of the present invention, the lubricant of the first application quantity, which is applied to the developer bearing member at a position further outward than the outer end of the seal member and is larger than the second application quantity, is supplied to the end of the cleaning member via the image bearing member. This suppresses turn-up of the end of the cleaning member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-213316, filed Oct. 20, 2014, which is hereby incorporated by reference herein in its entirety.

What is claimed is:

1. A developing device configured to be used for an image forming apparatus, the developing device comprising:

a developer container configured to accommodate a developer and to have an opening;

a developer bearing member configured to be rotatably provided and to bear the developer; and a seal member configured to be provided at an end of the opening of the developer container in an axial direction of the developer bearing member and to come into contact with a peripheral surface of the developer bearing member to suppress leakage of the developer borne by the developer bearing member, wherein a lubricant is applied to a surface of the developer bearing member, wherein, in the axial direction of the developer bearing member, an end of the developer bearing member is located further outward than an outer end of the seal member, and an end of a cleaning member is located further outward than the end of the developer bearing member, and wherein, in the axial direction of the developer bearing member, a first application quantity of the lubricant applied to the surface of the developer bearing member at a position further outward than the outer end of the seal member is larger than a second application quantity of the lubricant applied to the surface of the developer bearing member at a position corresponding to the opening.

2. The developing device according to claim 1, wherein the first application quantity and the second application quantity are each an application quantity per unit area.

3. The developing device according to claim 2, wherein the first application quantity is double to triple the second application quantity.

4. The developing device according to claim 1, wherein, in the axial direction of the developer bearing member, an end of an image bearing member provided at a part other than the developing device is located further outward than the end of the cleaning member.

5. The developing device according to claim 1, further comprising a regulation member configured to regulate a quantity of the developer on the surface of the developer bearing member, wherein, in the axial direction of the developer bearing member, the outer end of the seal member is located further outward than an end of the regulation member.

6. The developing device according to claim 1, further comprising a developer feed member configured to come into contact with the developer bearing member, and to supply the developer to the developer bearing member, wherein the second application quantity is equal to or more than a quantity necessary to avoid an occurrence of an adverse effect in an image due to contact of the developer feed member with the developer bearing member.

7. The developing device according to claim 1, wherein the second application quantity is less than a minimum quantity that leads to image soiling due to scraping off of the developer borne by the developer bearing member.

8. The developing device according to claim 1, wherein a developer is used as the lubricant.

9. A process cartridge detachably attachable to a main body of an image forming apparatus, the process cartridge comprising:

the developing device according to claim 1;

an image bearing member configured to bear an image of a developer; and a cleaning member configured to clean a surface of the image bearing member, wherein the first application quantity is equal to or more than a quantity necessary to avoid blade turn-up due to contact of the end of the cleaning member with the image bearing member.

10. An image forming apparatus comprising the developing device according to claim 1.

11. An image forming apparatus comprising the process cartridge according to claim 9.

* * * * *